United States Patent [19]

Van Den Bergh

[11] Patent Number: 5,012,948

[45] Date of Patent: May 7, 1991

[54] SUPPORT ARRANGEMENT FOR A SPACE BASED CRYOGENIC VESSEL

[75] Inventor: Hugo H. Van Den Bergh, San Diego, Calif.

[73] Assignee: General Dynamics Corporation, Convair Division, San Diego, Calif.

[21] Appl. No.: 369,448

[22] Filed: Jun. 21, 1989

[51] Int. Cl.[5] ..... F17C 3/08; F17C 13/08

[52] U.S. Cl. ..... 220/437; 220/420; 220/435; 220/901; 248/901

[58] Field of Search ..... 220/437, 435, 420, 425, 220/436, 439, 901; 248/901

[56] References Cited

U.S. PATENT DOCUMENTS

| | | | |
|---|---|---|---|
| 2,256,673 | 9/1941 | Hansen | 220/439 |
| 4,522,034 | 6/1985 | Laskaris | 62/45 |
| 4,606,201 | 8/1986 | Longsworth | 62/514 |
| 4,655,045 | 4/1987 | Matsumoto | 62/45 |

*Primary Examiner*—Stephen Marcus
*Assistant Examiner*—Stephen Cronin
*Attorney, Agent, or Firm*—John R. Duncan; Frank D. Gilliam

[57] ABSTRACT

A cryogenic vessel arrangement for a superconductive apparatus that is adapted to be launched into outer space for operation therein. A vacuum vessel, within which a liquid helium vessel containing the superconductive apparatus is positioned, is supported from an external frame. The liquid helium vessel is supported by a cable arrangement from the external frame independently of the vacuum vessel. The cable arrangement is preferably constructed to maintain a constant length throughout a service temperature range. A bumper arrangement is provided to provide direct support for the vacuum vessel independently of the cable arrangement during launch of the cryogenic vessel arrangement into space.

10 Claims, 2 Drawing Sheets

SUPPORT ARRANGEMENT FOR A SPACE BASED CRYOGENIC VESSEL

BACKGROUND OF THE INVENTION

1. Field of the Invention

The invention relates generally to improvements in space based cryogenic vessel arrangements and more particularly, but not by way of limitation, to an arrangement for supporting a cold mass within a vacuum vessel from an external frame independently of the vacuum vessel.

2. Description of the Prior Art

In conventionally designed cryogenic vessels, such as helium dewars or superconducting magnet systems, all of the forces exerted on the cold mass, which can be considered to be a helium vessel containing the superconducting apparatus and positioned within a vacuum vessel, are transmitted to the outside magnet or dewar supports through the walls of the vacuum vessel. Thus, the vacuum vessel has to be designed not only to withstand the vacuum generated loads, but also the additional loads of supporting the cold mass.

R. T. Parmley and P. Kittel in their report entitled "System Structural Test Results: Six PODS III Supports", Tenth Int. Cryogenic Engineering Conference, 1CEC10, Butterworth E. Co., VK (1984) disclose the state of the art with passive orbital disconnect strut (PODS) supports for helium dewars intended for space work. They disclose six deformable struts connected from a vacuum shell to the outer surface of the cryogen tank. As the tank diameter changes due to cool down or pressurization, the angled pinned end struts are free to move in and out as the tank moves up or down. A similar adjustment occurs automatically as the vacuum shell changes diameter in orbit due to temperature changes. Thus, the cryogen tank is supported directly from the vacuum shell rather than independently from the external support as in the instant invention.

U.S. Pat. Nos. 4,655,045; 4,606,201 and 4,522,034 are further examples of conventional cryogenic vessels that include an inner vessel containing a superconducting magnet and a freezing liquid of liquid helium or the like. The inner vessel is contained within a vacuum insulating vessel which thermally insulates the inner vessel. The inner vessel is directly supported by a plurality of support members whose outer ends are secured to the vacuum insulating vessel. None of these patents disclose a suspension for the inner vessel which connects directly to the external frame support of the vacuum insulating vessel independently of the insulating vessel.

SUMMARY OF THE INVENTION

In accordance with the present invention, there is provided a suspension for a cold mass of a space based cryogenic vessel that saves considerable weight over present designs. The invention contemplates an evacuated vacuum vessel that is supported from a suitable external frame and a cold mass in the form of an inner helium containing vessel that is directly supported from such external frame independently of the vacuum vessel. The independent support for the cold mass includes a cable that is connected at one end to the cold mass as by a clevis arrangement and at the other end to the external frame. The vacuum vessel is provided with a suitable bellows arrangement in its outer skin that surrounds the connection of the cable to the external support so as to permit movement of the cold mass while still maintaining the requisite vacuum within the vacuum vessel.

A bumper arrangement surrounds the cable and permits the load of the cold mass to be transmitted to the external frame during launch conditions since the cable will stretch sufficiently during launch to engage the bumper arrangement. The bumper arrangement will automatically disengage when the forces subside. The cable comprises lengths of material that have contrasting coefficients of thermal expansion so that the length of the cable remains relative constant over a range of expected temperatures.

Other features and attendant advantages of the present invention will become apparent to those skilled in the art from a reading of the following detailed description constructed in accordance with the accompanying drawings and wherein:

DESCRIPTION OF THE PREFERRED EMBODIMENT

Figure 1:
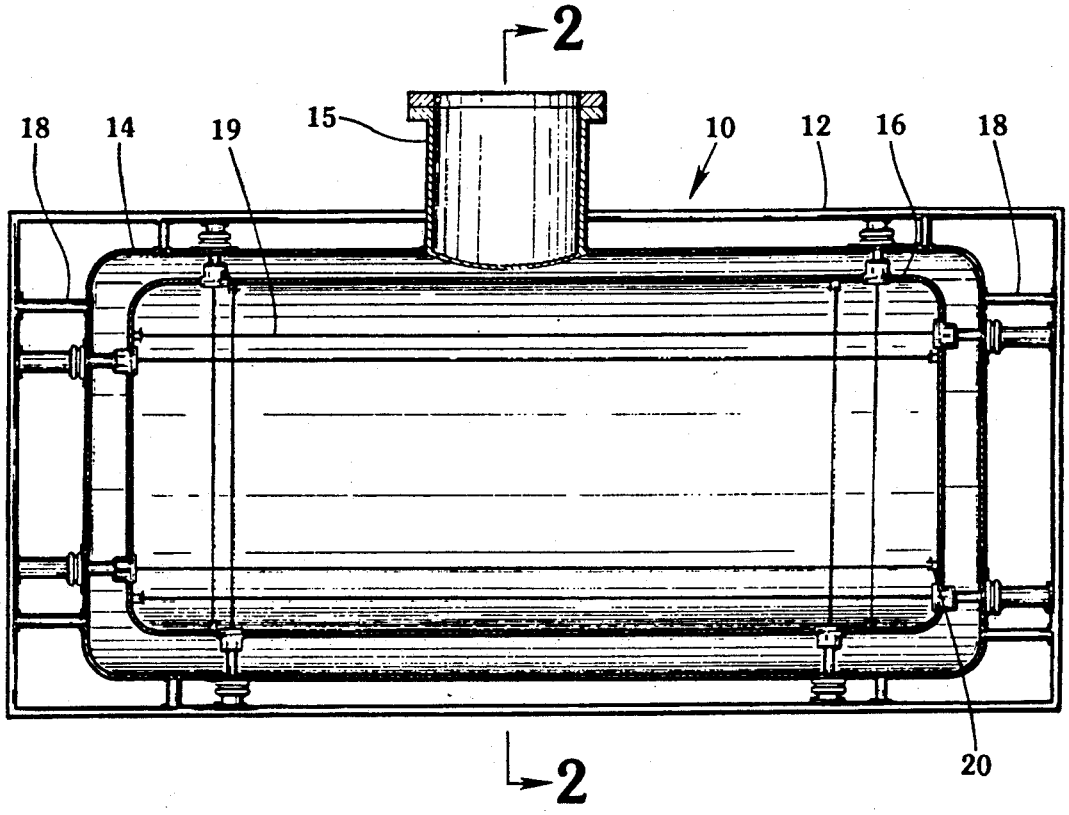
FIG. 1 is a simplified sectional that illustrates a preferred embodiment of a cryogenic vessel support arrangement constructed in accordance with the principles of the present invention.
Figure 2:
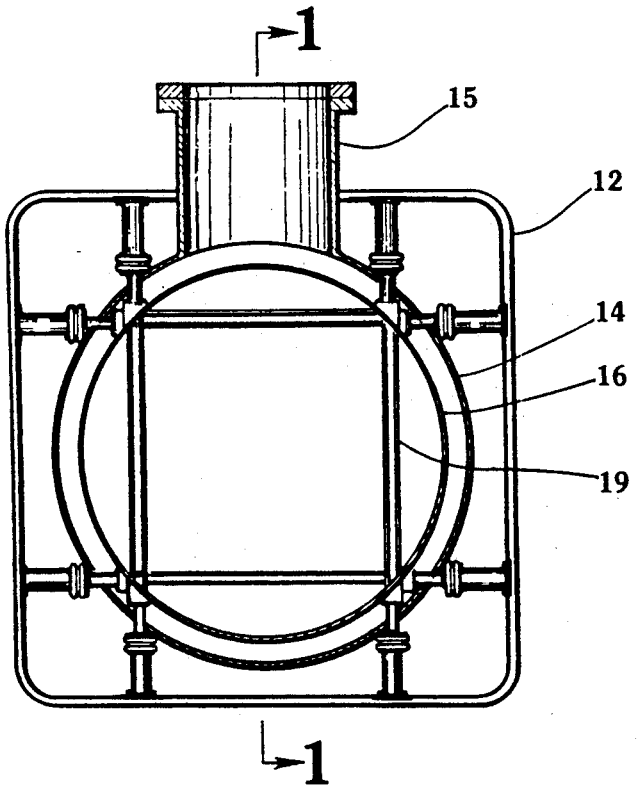
FIG. 2 is a simplified sectional taken along line 2—2 in FIG. 1 and further illustrates the cryogenic vessel support arrangement of the present invention and the general arrangement of the cryogenic vessel with a cold mass contained within a vacuum vessel, and external support system, and the launch bumper arrangement.

Referring now to the drawing in detail and in particular to FIGS. 1 and 2, the reference character 10 generally designates a space based cryogenic vessel arrangement for a superconducting apparatus constructed in accordance with the present invention. The cryogenic vessel arrangement 10 includes a suitable external frame 12 that provides support for a vacuum vessel 14 and a cold mass 16 contained within the vessel 14. A suitable port arrangement 15 extends through the external support frame 12 to the vacuum vessel 14 to provide access thereto from the exterior of the frame 12. The vacuum vessel 14 is supported within the external frame 12 by suitable supports 18 that constrain the vessel 14 against movement therewithin. Since the vacuum vessel 14, according to the present invention, does not have to provide support for the cold mass 16 it has only to withstand the internal vacuum and consequently it can be made lighter in weight than conventional construction. Since no heavy load carrying members are attached to the vacuum vessel 14 for supporting the cold mass 16 the wall of the vacuum vessel 14 may be of strong light weight construction. For example, the wall of the vessel could be an adhesively bonded honeycomb sandwich structure.

The cold mass 16 is contemplated to be a helium vessel adapted to contain a superconducting apparatus such as a superconductive magnet system. For ease of illustration in FIG. 1 and 2 only the general detail of the suspension system for the illustrated dewar are shown and all details of the superconductive apparatus are omitted. The cold mass 16 would generally be covered with a suitable multilayer superinsulation.

The cold mass 16 is supported from the external frame 12 by a cable assembly 19. The cable assembly 19 is connected at one end to the external frame 12 and to the cold mass 16 at its other end through a suitable clevis arrangement 20 secured to the exterior of the cold mass 16. The clevis arrangement 20 cooperates with the cable assembly 19 to permit the cold mass a desired range of movement within the vacuum vessel 14. It is to be understood that a plurality of such assemblies 19 are provided according to the particular requirements of the application.

Figure 3:
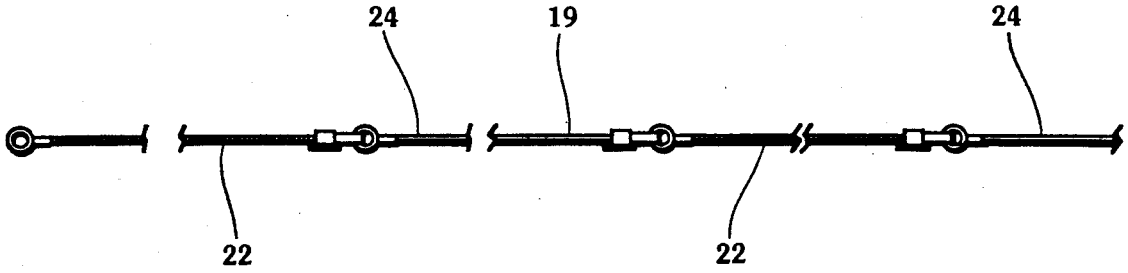
FIG. 3 is a simplified diagrammatic representation of the support cable assembly of the present invention that illustrates the constant length feature.

Referring briefly to FIG. 3, another feature of the cable assembly 19 is illustrated. Preferably, the cable assembly 19 comprises a plurality of support cables that are connected in any known manner in a series arrangement. Certain of the support cables designated 22 are constructed of a material that expands during a decrease in temperature, such as Aramid fibers. Other sections of the support cables designated 24 are constructed of a material that contracts during a decrease in temperature, such as stainless steel. By choosing sections 22 and 24 that have contrasting coefficients of thermal expansion and predetermining the lengths of the sections 22 and 24 of the support cables 19, the overall length of the cable assembly 19 remains relatively constant and no thermal stresses are generated in the cable assembly 19 during cool down. Thus, the diameter of the cable assembly 19 may be reduced thereby resulting in further weight savings.

Figure 4:
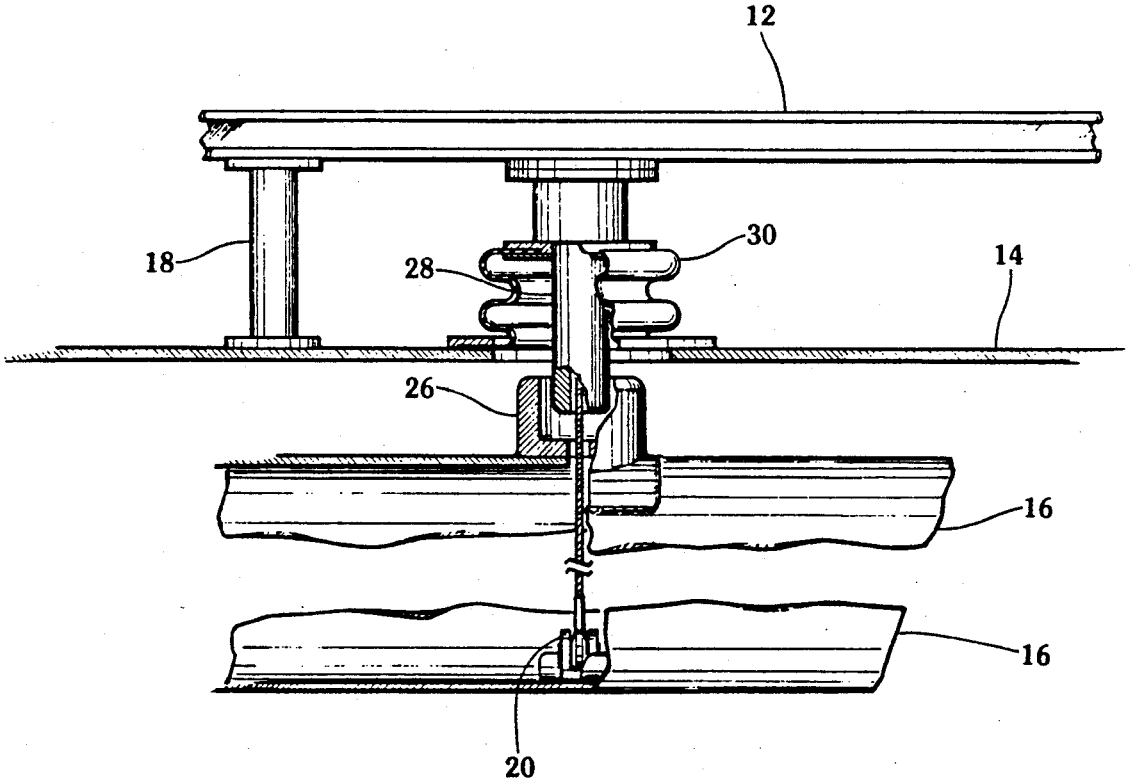
FIG. 4 is a simplified section of the cryogenic vessel support arrangement that particularly illustrates the bumper arrangement aspect of the invention.

As shown in FIGS. 1 and 2 when the illustrated dewar is at its station in space the cold mass 16 is supported in place only by the cable assembly 19. During a launch condition the cable assembly 19 is designed to stretch a sufficient amount to permit a bumper assembly 26, seen most clearly in FIG. 4, carried by the external frame 12 and the cold mass 16 to engage and permit to launch loads of the cold mass 16 to be transmitted to the exterior vacuum vessel support structure 12. The engagement of the bumper assembly 26 results in a much larger heat transfer into the cold mass 16 but this condition occurs only during launch.

The bumper assembly 26 through which the cable assembly 19 preferably extends includes a tubular member 28, that is connected to the external frame 12. The tubular member 28 is connected to the frame 12 through a suitable bellows arrangement 30 provided in the outer skin of the vacuum vessel 14 so as to permit movement of the helium vessel 16 therewithin without disturbing the integrity of the vacuum conditions.

The tubular member 28 is adapted to be received within a complementarily shaped bumper member that is suitably fastened to a bulkhead of the helium vessel 14. Since the cable assembly 19 passes through the bumper 26 and the bellows 28 it will be seen that as one cable assembly 19 stretches on one side of the cold mass 16, a cable assembly 19 at another location on the cold mass 16 permits the bumper assembly 26 to engage.

From the foregoing, it has been shown that the present invention provides a novel suspension for a space based dewar system that permits the cold mass in the form of a helium vessel to be independently supported from an external support frame that independently also supports the vacuum vessel. The novel arrangement provides support for the helium vessel in both the launch condition and the orbit condition. Thus, the present invention provides a cryogenic system that is simple in construction and light weight.

Although the present invention has been shown and described with reference to a particular embodiment, nevertheless, various changes and modifications obvious to one skilled in the art to which the invention pertains are deemed with in the purview of the invention.

What is claimed is:

1. In a space based cryogenic vessel arrangement for a superconducting apparatus that includes an external support frame and an evacuated vacuum vessel which contains a vessel adapted to receive liquid helium or the like and a superconductive apparatus, said contained vessel being spaced from said vacuum vessel, the improvement comprising;

means for supporting said contained vessel independently of said surrounding vacuum vessel by a connection directly between said external frame and said contained vessel, said means for supporting the contained vessel comprises at least one cable assembly, said at least one cable assembly having interconnected lengths of material having contrasting coefficients of thermal expansion.

2. The cryogenic vessel arrangement of claim 1 wherein said vacuum vessel is directly supported from said external frame and said contained vessel penetrates connection penetrates said vacuum vessel skin through a flexible bellows arrangement for permitting said vacuum vessel and said contained vessel to move independently of each other without disturbance of cryogenic conditions.

3. The cryogenic vessel arrangement of claim 1 wherein said cable assembly is connected to said exterior frame at one end and is connected at the other end to said contained vessel.

4. The cryogenic vessel arrangement of claim 3 wherein said cable assembly is connected to said contained vessel of a suitable clevis arrangement that permits a degree of physical movement of said contained vessel relative to said external frame.

5. The cryogenic vessel arrangement of claim 1 wherein said at least one cable assembly comprises at least one length of a first material which contracts in a cooling temperature environment and at least one length of a second material that expands in a cooling temperature environment, the lengths of said first and second material being predetermined to provide said at least one cable assembly with a length that remains substantially constant through a wide service temperature range that is experienced by the cryogenic vessel during its anticipated mission between launch on earth and orbit in space.

6. The cryogenic vessel arrangement of claim 2 wherein said means to support said contained vessel further includes a cooperating bumper arrangement to permit the load of said contained vessel to be transmitted directly to said external frame at times such as launch of the cryogenic vessel arrangement into space when contained vessel movement relative to the external frame occurs.

7. The cryogenic vessel arrangement of claim 6 wherein said bumper arrangement comprises a cylindrical tubular member connected to the external frame and a cooperating complementarily shaped member fixed to the outer surface of said contained vessel and adapted to receive said tubular member when said contained vessel is moved toward the vacuum vessel, said cable assembly extending through said bumper arrangement for suspending said contained vessel independently of the support that is provided to said vacuum vessel by said external frame.

8. The cryogenic vessel arrangement of claim 7 wherein said tubular member connected to said external frame is positioned within said flexible bellows arrangement whereby as said contained vessel moves toward an inner wall of said vacuum vessel said bellows arrangement flexes to permit the complimentarily shaped member of said bumper arrangement carried by said contained vessel to engage said tubular member while maintaining the vacuum condition within said vacuum vessel.

9. The cryogenic vessel arrangement as defined in claim 5 wherein said first material is stainless steel and said second material is an advanced organic material.

10. The cryogenic vessel arrangement as defined in claim 9 wherein said second material is Aramid fibers.

* * * * *